United States Patent [19]

Fischer et al.

[11] 4,244,461

[45] Jan. 13, 1981

[54] DEFLECTING DEVICE FOR FOLDED SHEET PRODUCTS

[75] Inventors: Robert Fischer, Heuchelheim; Rudolf Stäb, Wachenheim, both of Fed. Rep. of Germany

[73] Assignee: Albert-Frankenthal AG, Frankenthal, Fed. Rep. of Germany

[21] Appl. No.: 40,006

[22] Filed: May 17, 1979

[30] Foreign Application Priority Data

May 27, 1978 [DE] Fed. Rep. of Germany ..... 2823247

[51] Int. Cl.[3] ..... B65G 47/30

[52] U.S. Cl. ..... 198/456; 198/817

[58] Field of Search ..... 198/365, 366, 369, 436, 198/456, 457, 578, 587, 575, 606, 817

[56] References Cited

U.S. PATENT DOCUMENTS

| | | | |
|---|---|---|---|
| 1,292,178 | 1/1919 | Waterman | 198/436 |
| 1,489,926 | 4/1924 | Burtchaell | 198/457 X |
| 2,371,877 | 3/1945 | Crosland | 198/457 |
| 2,633,224 | 3/1953 | Thebault | 198/578 X |
| 2,959,269 | 11/1960 | Kammerer | 198/587 X |

FOREIGN PATENT DOCUMENTS

| | | | |
|---|---|---|---|
| 295382 | 7/1915 | Fed. Rep. of Germany | 198/457 |
| 2230408 | 1/1974 | Fed. Rep. of Germany | 198/578 |

*Primary Examiner*—James L. Rowland

*Attorney, Agent, or Firm*—Allison C. Collard; Thomas M. Galgano

[57] ABSTRACT

A device for deflecting a product stream consisting, in particular, of folded sheet products, from a first to at least one following longitudinal conveying device which are laterally displaced apart is provided. The distance between the first and second longitudinal conveying device is bridged by a further longitudinal conveying device which is inclined to an extent corresponding to the lateral displacement of the first and second longitudinal conveying device. The further longitudinal conveying device preferably includes two parallel, uniformly-driven conveying elements positioned adjacent to one another.

4 Claims, 1 Drawing Figure

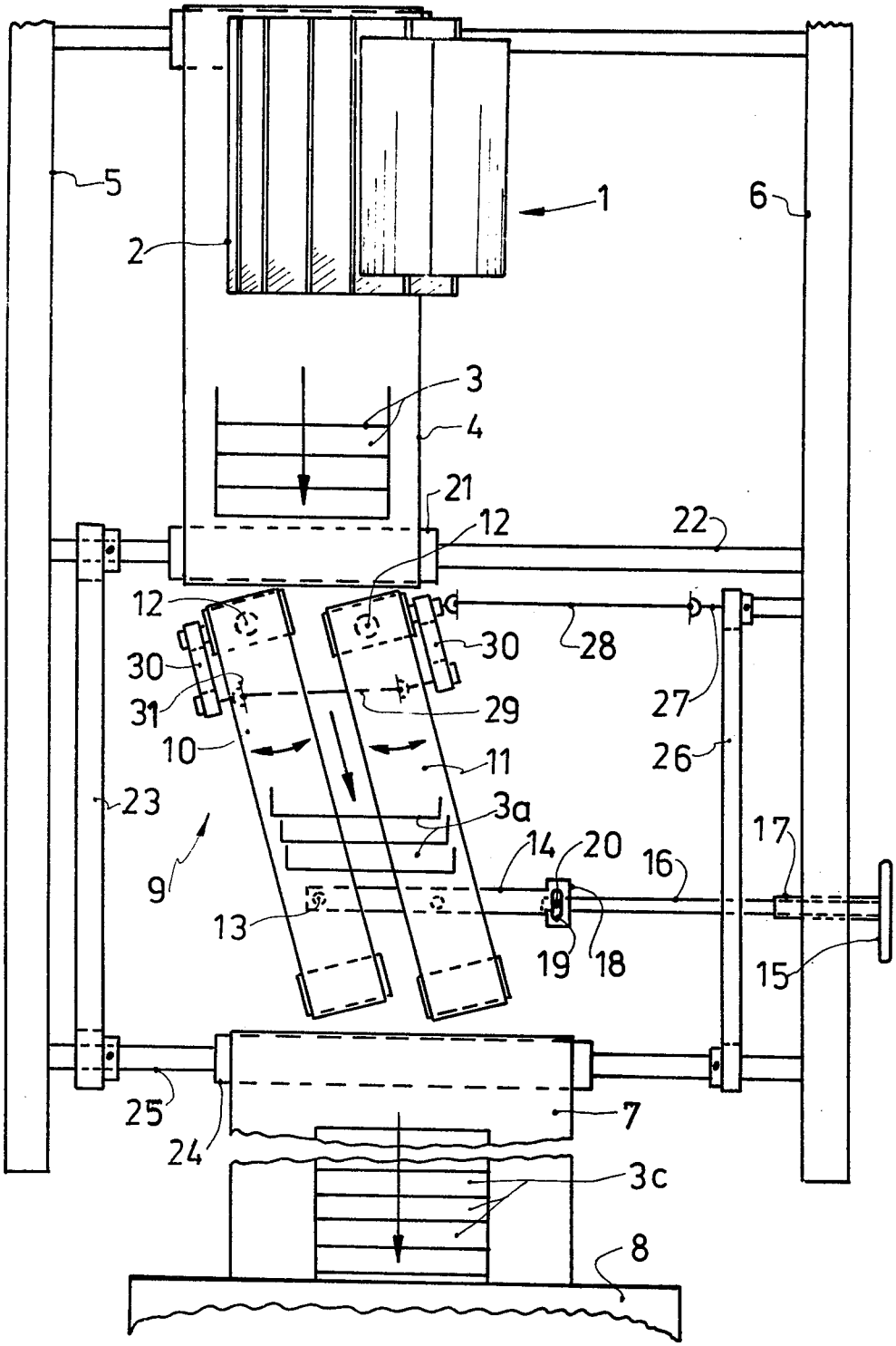
1
2
3
4
5
6
7
8
9
10
11
12
12
13
14
15
16
17
18
19
20
21
22
23
24
25
26
27
28
29
30
30
31
3a
3c

DEFLECTING DEVICE FOR FOLDED SHEET PRODUCTS

The present invention relates to a device for deflecting a product stream. More particularly, it relates to a device for deflecting a product stream consisting in particular of folded sheet products, from a first to at least one following longitudinal conveying means, which means are laterally displaced with respect to one another.

Devices of this nature are used, for example, in folding apparatuses which are provided with a means for making a third fold. As is known, the third fold is followed by a lateral displacement of the product stream with respect to the path along which the product was hitherto guided—namely, in the middle part of the folding apparatus, due to the products, having been once again folded longitudinally; the thus folded products being passed into a bucket wheel which, after turning through 90°, deposits the products onto a conveyor belt, so as to effect a lateral displacement corresponding approximately to the radius of turning by the bucket wheel. Depending on whether the product is folded three times or only twice, the product stream is displaced with respect to the middle of the folding apparatus or not. However, if the folding apparatus is followed by devices for further mechanical processing of the folded products, e.g. packet delivery etc., it is necessary for the product stream to remain unchanged in position.

A possible solution would be to mount the packet delivery etc. so as to allow shifting, and to move it according to production. Clearly, however, this is clumsy and expensive. It would also be conceivable to deflect the product stream, laterally displaced following the third fold, by means of using conical rollers. However, this too has proved to be awkward and expensive, and is particularly disadvantageous in that the arrangement does not allow for any setting or adjustment.

It is therefore an object of the present invention to create a device of the above-mentioned type which is especially suitable, among other things, for a folding apparatus provided with a means for making a third fold.

It is a further object of the present invention to provide such a device which is simply and distinctly constructed, which allows exact adaptation of the deflection to the various degrees of displacement of the product stream and which guarantees, at the same time, that the products to be deflected will not undergo any turning while being deflected.

These objects are achieved according to the invention in a surprisingly simple manner, namely—in that the distance between the first and the second longitudinal conveying means is bridged by a further longitudinal conveying means which is inclined to an extent corresponding to the lateral displacement of the first and second conveying means. This further longitudinal conveying means comprises two parallel, uniformly-driven conveying elements positioned adjacent to one another.

Use of a longitudinal conveying means for deflection purposes advantageously results in simple construction and extremely economical production. As a result of the simple oblique arrangement, the products taken up onto this bridging conveying means retain their alignment as exhibited on the longitudinal conveying means preceding the deflecting device, and are then deposited in this position, without any turning, onto the following longitudinal conveying means. This advantageously guarantees a problem-free and ordered transfer of the products from the second longitudinal conveying means to the next processing stage. At the same time, a longitudinal conveying means inclined for purposes of deflection can be adjusted for practically every desired displacement. By simply altering the inclination, simple positioning of the product stream leaving the deflecting device is possible.

It is advantageous if the parallel adjacent conveying elements of the deflecting device are swingably mounted about an axis running vertical to the plane of conveyance, and if they are coupled with an adjusting device.

Other objects and features of the present invention will become apparent from the following detailed description, considered in connection with the accompanying drawing, which discloses an embodiment of the invention. It is to be understood, however, that the drawing is designed for the purpose of illustration only, and not as a definition of the limits of the invention.

The single FIGURE constituting the drawing illustrates a schematic top view of a mounting arrangement on the basis of a folding apparatus provided with a means for making a third fold in accordance with the invention.

Referring now in detail to the drawing a pair of folding cylinders 1 is fed products, previously folded lengthwise and crosswise, in order to be folded again—in other words a third fold—in lengthwise direction. Positioned after the folding cylinders there is a bucket wheel 2, known per se, which takes up the products now provided with a third fold and deposits them, in the form of a broken stream indicated by 3, onto a conveyor belt 4.

Up as far as the folding cylinder pair 1 the product stream is conveyed approximately in the middle of the folding apparatus, i.e. in the middle region between side walls 5 and 6 of the folding apparatus. Bucket wheel 2 then effects a lateral displacement of the product stream to an extent of half its diameter. With respect to the middle of the folding apparatus, a conveyor belt 4 is thus positioned with a corresponding lateral displacement. Positioned after conveyor belt 4, which constitutes a first longitudinal conveying means, there is a second longitudinal conveying means provided by a conveyor belt 7. Conveyor belt 7 feeds a receiving station 8, for example a packet delivery. Receiving station 8 is normally positioned in the middle of the folding apparatus. The same holds therefore for conveyor belt 7 serving to feed receiving station 8. With production where only two folds are necessary, the product stream can be fed to conveyor belt 7 without any deflection. To effect a central supply to receiving station 8 when the products have been folded three times, the distance between conveyor belt 4, constituting a first longitudinal conveying means and being displaced laterally with respect to the middle of the folding apparatus, and conveyor belt 7, constituting a second longitudinal conveying means and being positioned centrally, is bridged by a deflecting device, generally designated by reference numeral 9, through which the product stream displacement caused by bucket wheel 2 is practically cancelled out.

Deflecting device 9 has a further longitudinal conveying means which comprises two parallel conveyor belts 10 and 11 positioned adjacent to one another.

Conveyor belts 10 and 11 of deflecting device 9 are inclined with respect to the longitudinal axis of the machine to a degree corresponding to the lateral displacement of conveyor belts 4 and 7. The adjacent-positioned conveyor belts 10 and 11 accordingly draw off the product stream arriving via conveyor belt 4 obliquely forwards, without the individual products being subjected to a rotating movement. Rather than this, the products taken up onto conveyor belts 10 and 11 retain their alignment as exhibited on preceding conveyor belt 4, i.e. the front edges of the products maintain a parallel alignment. Otherwise there is only a fanning out, in the direction of displacement, of the product stream, indicated by 3*a*. As the products are not subjected to any turning, the alignment of the products on conveyor belt 7, adjoining deflecting device 9, automatically matches the product alignment on conveyor belt 4 preceding deflecting device 9, which guarantees problem-free transfer of the product stream, denoted by 3*c*, into receiving station 8.

In the particularly preferred embodiment illustrated, conveyor belts 10 and 11 of deflecting means 9 are pivotably or swingably mounted about an axis 12 which is approximately vertical with respect to the plane of conveyance. This permits an accurate adjustment of the inclination of conveyor belts 10 and 11 both when presetting the machine and during operation. For the formation of a suitable adjusting device, an adjusting arm 14 is provided, which is jointed at 13 with conveyor belts 10 and 11, respectively, and is coupled with an adjusting spindle 16 that is supported by the machine framework and is actuated by means of a handwheel 15. At the wall end, adjusting spindle 16 fits into a bushing 17, also accommodating handwheel 15, in the machine frame. The distance between pivotal points 13 of adjusting arm 14 corresponds to the distance between rotational axes 12, which guarantees exact parallel positioning of conveyor belts 10 and 11 at every pivoting angle. At the same time, the four-point jointed arrangement guarantees that, in the case of any swinging movement of conveyor belts 10 and 11, adjusting arm 14 can only undergo parallel displacement, which renders the articulation of adjusting spindle 16 much easier. To compensate for this parallel displacement, adjusting arm 14 can have a sort of muff or collar 18 with a slot 19 into which pin 20 of adjusting spindle 16 fits. The swingably mounted conveyor belts 10 and 11 of deflecting device 9 thus guarantee complete variability with respect to the desired degree of deflection; this is particularly advantageous when working with formats of different sizes, since the product stream is deposited by bucket wheel 2 practically from the side onto conveyor belt 4 but, on the other hand, is fed centrally to receiving station 8.

Conveyor belts 10 and 11 each have a self-supporting framework (not shown in detail) which, on one hand, is pivoted and, on the other hand, can expediently be supported in form of a sliding carriage. In the embodiment illustrated, rotational axes 12 are located in that area of the conveyor belts 10 and 11 which is in immediate vicinity to conveyor belt 4. This results in a broad adjustment range in the region of conveyor belt 7.

Conveyor belts 3, 10 and 11, and 7 for transporting the product stream should all be driven uniformly. Synchronized single motors can be used for this. In the embodiment illustrated, these conveyor belts are drive-coupled with one another. In this connection, for example, shaft 22, which is coupled with the main drive and on which the anterior belt roller 21 of conveyor belt 4 is mounted, is connected via a toothed belt 23 with shaft 25, on which the rear belt roller 24 of conveyor belt 7 is mounted. Shaft 25 is connected by means of a toothed belt 26, opposite toothed belt 23, with a short drive rod 27 for conveyor belts 10 and 11 of deflecting device 9. From drive rod 27, a universal shaft 28 leads to the drive unit of deflecting device 9. In order to effect a compensation in length, universal shaft 28 is constructed as a telescopic shaft. Conveyor belts 10 and 11 of deflecting device 9 are likewise coupled with each other by means of a universal shaft 29. As long as the belt distance is large enough, universal shaft 29 can simply be positioned between the opposing sides of neighboring belt rollers. In the embodiment illustrated, universal shaft 29 is mounted between two gear reducer units 30 provided in the region of the averted flanks of conveyor belts 10 and 11; this clearly results in a desirable increase in the length of the shaft. Universal shaft 29 can also be designed as a telescopic shaft in order to balance the length. As long as the distance between pivotal shaft points 31 corresponds to the distance between rotational axes 12, a length compensation of this nature is not necessary.

As can readily be appreciated, the foregoing disclosure constitutes a detailed explanation of a particularly preferred embodiment of the invention but does not imply that any limitation be attached to it. One skilled in the art has much rather a series of possibilities at his disposal with which to adapt the general thinking of the invention to suit the individual case. For example, in the region of deflecting device 9, fewer or preferably more than two conveyor belts could be provided. It is also easy to see that the measures according to the invention, diverging from the mounting arrangement illustrated, present a simple possibility for formation of a product deflector with which, according to choice, two or more product routes positioned subsequent to a first longitudinal conveying means can be fed.

Thus, while only a single embodiment of the present invention has been shown and described, it will be obvious that many modifications and changes may be made thereinunto, without departing from the spirit and scope of the invention.

What is claimed is:

1. In a device for deflecting a product stream of folded sheet products from a first to at least a second longitudinal conveyor belt, said belts being laterally displaced with respect to one another, the improvement comprising:

a supplemental longitudinal conveying means which bridges the distance between the first and the second longitudinal conveyor belts and which is inclined to an extent corresponding to the lateral displacement of said first and second longitudinal conveyor belts, said longitudinal conveying means comprising two parallel, synchronously-driven conveyor belts positioned adjacent to one another which are each pivotably mounted about a pivot axis approximately running normally to the plane of conveyance and which are coupled with an adjusting device for adjusting their pivotable position, said adjusting device having an adjusting arm which is pivotably coupled with each of said parallel, adjacent conveyor belts at respective pivot points so that the distance between said pivot points of said adjusting arm is the same as the distance between the pivot axes, said arm being coupled with an adjusting spindle supported by an outer machine casing by means of a pin-slot connection.

2. The deflecting device according to claim 1, wherein said adjacent conveying elements are drive-coupled with each other by means of at least one universal shaft and are drive-coupled with the preceding and following first and second longitudinal conveying means by means of at least one universal shaft.

3. The deflecting device according to claim 2, wherein at least the universal shaft coupled with the drive for the preceding and following longitudinal first and second conveying means is designed as a telescopic shaft.

4. The deflecting device according to claim 2, wherein said adjacent conveying elements are each provided on a flank thereof with a gear-reducer connected to the universal shaft drive-coupling said elements with one another.

* * * * *